US007960319B2

(12) United States Patent
Nagamatsu

(10) Patent No.: US 7,960,319 B2
(45) Date of Patent: Jun. 14, 2011

(54) LUBRICATING OIL COMPOSITION

(75) Inventor: Hiroyuki Nagamatsu, Gotenba (JP)

(73) Assignee: Chevron Japan Ltd., Tokyo (JP)

( * ) Notice: Subject to any disclaimer, the term of this patent is extended or adjusted under 35 U.S.C. 154(b) by 668 days.

(21) Appl. No.: 11/956,151

(22) Filed: Dec. 13, 2007

(65) Prior Publication Data

US 2008/0167207 A1 Jul. 10, 2008

(30) Foreign Application Priority Data

Jan. 5, 2007 (JP) ..... 2007-000690

(51) Int. Cl.
*C10M 159/20* (2006.01)
*C10M 141/12* (2006.01)

(52) U.S. Cl. ..... 508/192; 508/371; 508/375; 508/460; 508/574

(58) Field of Classification Search ..... 508/186, 508/192
See application file for complete search history.

(56) References Cited

U.S. PATENT DOCUMENTS

| | | | | |
|---|---|---|---|---|
| 2002/1091069 | | 7/2002 | King | |
| 2002/0119896 | A1 * | 8/2002 | Yagishita et al. | 508/291 |
| 2002/0123434 | A1 * | 9/2002 | Nagamatsu et al. | 508/192 |
| 2006/0116298 | A1 | 6/2006 | Chambard et al. | |

FOREIGN PATENT DOCUMENTS

| | | | |
|---|---|---|---|
| EP | 0331359 | | 9/1989 |
| EP | 0331359 | A | 9/1989 |
| EP | 0786448 | | 7/1997 |
| JP | P2005-263860 | A | 9/2005 |
| JP | P2005-263861 | A | 9/2005 |
| WO | 1998/50501 | | 11/1998 |
| WO | WO 98/50501 | A | 11/1998 |

OTHER PUBLICATIONS

International Search Report and Written Opinion issued in counterpart Singapore Patent Application No. 200800132-3, Dec. 29, 2009.

* cited by examiner

*Primary Examiner* — Ellen M McAvoy
*Assistant Examiner* — Ming Cheung Po

(57) ABSTRACT

A lubricating oil composition favorably employable for trunk piston diesel engines contains an overbased sulfurized alkylphenol calcium salt, at least two (preferably three) overbased alkylsalicylic acid calcium salts having different base ratios and hydrocarbyl groups of different carbon atom numbers, a borated ashless dispersant, and a zinc dihydrocarbyldithiophosphate.

15 Claims, No Drawings

LUBRICATING OIL COMPOSITION

FIELD OF THE INVENTION

The present invention relates to a lubricating oil composition particularly favorable when employed as a lubricating oil composition in a four-stroke trunk piston marine diesel engine.

BACKGROUND OF THE INVENTION

A conventionally employed lubricating oil composition for lubricating a trunk piston marine diesel engine contains a variety of additive components which serve to improve various performances of the lubricating oil and prolong life of the lubricating oil.

A typical lubricating oil for the trunk piston diesel engine comprises an overbased metal-containing detergent such as an overbased calcium sulfonate (overbased alkylbenzenesulfonic acid calcium salt detergent), an overbased calcium phenate (overbased sulfurized alkylphenol calcium salt detergent) or an overbased calcium salicylate (overbased alkylsalicylic acid calcium salt detergent) and additives such as an ashless dispersant dispersed or dissolved in a base oil having a kinematic viscosity of approx. 22-300 $mm^2/s$ (measured at 40° C.).

Thus, the lubricating oil for the trunk piston diesel engine contains an overbased metal-containing detergent for neutralizing acidic sulfur oxides (particularly, sulfuric acid) which are produced after combustion of sulfur components contained in petroleum fuels such as A heavy oil or C heavy oil which contains a large amount of sulfur components. The metal-containing detergent serves in combination with an ashless dispersant to neutralise the sulfur oxides and further to uniformly disperse combustion residues such as soot and sludge produced by combustion of the fuel and deterioration of the lubricating oil, whereby keeping the combustion residues from depositing on various parts of the combustion engines such as a piston, piston grooves and a cylinder liner surface.

Recently, studies for the purpose of decreasing fuel consumption in a trunk piston diesel engine have been performed. It is known that the fuel consumption is affected by wear of a top ring of a piston. In more detail, when excessive wear occurs on the piston ring, a fuel gas is apt to escape from the space between the cylinder liner and the piston ring suffering wear. Therefore, the fuel consumption increases.

Recently, lubricating oils formulated specifically for trunk piston diesel engines generally utilize an overbased sulfurized alkylphenol calcium salt detergent and an overbased alkylsalicylic acid calcium salt detergent as the main metal-containing detergent, so as to increase detergency of the internal combustion engines subjected to operations at high temperatures.

Japanese Patent Provisional Publication 2005-263860 (Patent Publication 1) teaches that a lubricating oil composition containing a combination ox a salicylate detergent having one hydrocarbyl group containing 8 to 19 carbon atoms and a salicylate detergent having one hydrocarbyl group having 20 to 32 carbon atoms is favorably employed for lubricating internal combustion engines for the use in marine vehicles, power generation and railways, particularly, a four-stroke trunk piston internal combustion engine.

Japanese Patent Provisional publication 2005-263861 (Patent Publication 2) teaches that a lubricating oil composition containing a combination of (A) an alkali metal salicylate or an alkaline earth metal salicylate and/or its basic or overbased salt and (B) a metal-containing detergent having a BN of 240 mg·KOH/g or more and/or a metal ratio of 4.5 or more is favorably employed for lubricating internal combustion engines for the use in marine vehicles, power generation and railways, particularly, a four-stroke trunk piston internal combustion engine.

DETAILED DESCRIPTION OF THE INVENTION

As a result of studies by the inventor of the present invention, it was found that the conventional lubricating oil compositions containing a metal-containing detergent comprising overbased alkylsalicylic acid calcium salts are good in detergency at high temperatures, soot dispersability and storage stability but are not effective in reduction of the aforementioned wear of the top ring of the piston.

Accordingly, it is an object of the invention to provide a lubricating oil composition which contains a metal-containing detergent comprising the overbased alkylsalicylic acid calcium salts and is effective in the reduction of the aforementioned wear of the top ring of the piston.

It is another object of the invention to provide a lubricating oil composition favorably employable for lubricating a trunk piston diesel engine.

The present inventor has discovered that a lubricating oil composition which is effective in the reduction of the wear of the top ring of the piston of a diesel engine can be obtained by using an overbased sulfurized alkylphenol calcium salt in combination of two or more overbased alkylsalicylic acid calcium salts in which a base ratio expressed in terms of the calcium content in the overbase portion/calcium content in the soap portion and the length of the hydrocarbyl group of the salicylic acid are well adjusted and further using additionally a borated ashless dispersant. The present invention has been made based on this discovery.

In one aspect, the present invention resides in a lubricating oil composition (Lubricating Oil Composition of Invention-1) comprising the below-described additive components dissolved or dispersed in a base oil (preferably having a kinetic viscosity at 40° C. in the range of 22 to 300 $mm^2/s$):

(1) an overbased sulfurized alkylphenol calcium salt having a TBN of 200 to 300 mg·KOH/g, in an amount of 0.06 to 0.25 wt. % (percentage based on the total amount of the lubricating oil composition; this is the same in the following) in terms of a calcium content;

(2) an overbased alkylsalicylic acid calcium salt having a base ratio of 1.8 to 2.5 and one hydrocarbyl group of 14 to 18 carbon atoms, the base ratio being expressed in terms of a calcium content in an overbase portion per a calcium content in a soap portion, in an amount of 0.05 to 0.75 wt. % in terms of a calcium content;

(3) an overbased alkylsalicylic acid calcium salt having a base ratio of 4.2 to 5.8 and one hydrocarbyl group of 20 to 28 carbon atoms, the base ratio being expressed in terms of a calcium content in an overbase portion per a calcium content in a soap portion, in an amount of 0.19 to 1.05 wt. % in terms of a calcium content;

(4) a borated ashless dispersant in an amount of 0.005 to 0.06 wt. % in terms of a nitrogen content and 0.001 to 0.02 wt. % in terms of a boron content; and (5) a zinc dihydrocarbyldithiophosphate in an amount of 0.01 to 0.1 wt. % in terms of a phosphorus content.

In another aspect, the invention resides in a lubricating oil composition (Lubricating Oil Composition of Invention-2) comprising the below-described additive components dissolved or dispersed in a base oil (preferably having a kinetic viscosity at 40° C. in the range of 22 to 300 $mm^2/s$):

(1) an overbased sulfurized alkylphenol calcium salt having a TBN of 200 to 300 mg·KOH/g, in an amount of 0.06 to 0.40 wt. % in terms of a calcium content;

(2) an overbased alkylsalicylic acid calcium salt having a base ratio of 1.8 to 2.5 and one hydrocarbyl group of 14 to 18 carbon atoms, the base ratio being expressed in terms of a calcium content in an overbase portion per a calcium content in a soap portion, in an amount of 0.05 to 0.5 wt. % in terms of a calcium content;

(3) an overbased alkylsalicylic acid calcium salt having a base ratio of 3.6 to 4.5 and one hydrocarbyl group of 20 to 28 carbon atoms, the base ratio being expressed in terms of a calcium content in an overbase portion per a calcium content in a soap portion, in an amount of 0.08 to 1.55 wt. % in terms of a calcium content;

(4) an overbased alkylsalicylic acid calcium salt having a base ratio of 7.7 to 8.7 and one hydrocarbyl group of 20 to 28 carbon atoms, the base ratio being expressed in terms of a calcium content in an overbase portion per a calcium content in a soap portion, in an amount of 0.1 to 0.70 wt. % in terms of a calcium content;

(5) a borated ashless dispersant in an amount of 0.005 to 0.06 wt. % in terms of a nitrogen content and 0.001 to 0.02 wt. % in terms of a boron content; and (6) a zinc dihydrocarbyldithiophosphate in an amount of 0.01 to 0.1 wt % in terms of a phosphorus content.

In the present invention, TBN means a total base number (unit; mg·KOH/g).

In the invention, the "base ratio expressed in terms of a calcium content in an overbase portion per a calcium content in a soap portion" means a ratio of a numerator (amount of calcium which contributes to over-basing) per a denominator (amount of calcium in a non-overbased alkylsalicylic acid calcium salt). The high base ratio means that the component is highly overbased. The base ratio can be determined by the following measurements and calculations:

measurement of the amount of the alkylsalicylic acid in the overbased alkylsalicylic acid calcium salt component;

calculation for obtaining the amount of calcium required for neutralizing the measured amount of the alkylsalicylic acid to determine the denominator;

measurement of the amount of calcium in the overbased alkylsalicylic acid calcium acid component; and calculation by subtracting the amount of calcium of the denominator from the measured calcium amount to determine the numerator.

The lubricating oil composition of the invention is of value particularly for the use in four-stroke trunk piston diesel engines. In more detail, the lubricating oil composition of the invention is excellent not only in dispersability at high temperatures, dispersion of soot and storage stability but also in reduction of wear of the piston top ring.

Preferred embodiments of the Lubricating Oil Composition of Invention-1 are set forth below:

1) The lubricating oil composition has a TBN of 20 to 60.

2) The overbased alkylsalicylic acid calcium salt of (2) has a TBN of 120 to 220 mg·KOH/g.

3) The overbased alkylsalicylic acid calcium salt of (3) has a TBN 230 to 340 mg·KOH/g.

4) The borated ashless dispersant is a succinimide compound containing a boron atom in a molecular structure thereof.

5) The sine dihydrocarbyldithiophosphate is a primary zinc dihydrocarbyldithiophosphate.

Preferred embodiments of the Lubricating Oil Composition of Invention-2 are set forth below:

1) The lubricating oil composition has a TBN of 20 to 60.

2) The overbased alkylsalicylic acid calcium salt of (2) has a TBN of 120 to 220 mg·KOH/g.

3) The overbased alkylsalicylic acid calcium salt of (3) has a TBN 200 to 270 mg·KOH/g.

4) The overbased alkylsalicylic acid calcium salt of (4) has a TBN 280 to 350 mg·KOH/g.

5) The borated ashless dispersant is a succinimide compound containing a boron atom in a molecular structure thereof.

6) The zinc dihydrocarbyldithiophosphate is a primary zinc dihydrocarbyldithiophosphate.

Base Oil

The base oil used for the lubricating oil composition of the invention preferably is a mineral oil or a synthetic oil having a kinetic viscosity of approx. 22 to 300 $mm^2/s$ (measured at 40° C.). More preferred is a mineral oil or a synthetic oil having a kinetic viscosity of approx. 22 to 140 $mm^2/s$ (measured at 40° C.). The mineral oil can be a refined oil which is prepared by the steps of distilling a exude oil at an atmospheric pressure or a reduced pressure and refining thus obtained distillate by solvent deasphalting, solvent extraction, hydrocracking, solvent dewaxing, or hydrogenation.

Metal-Containing Detergent

The lubricating oil composition of the invention contains an overbased sulfurized alkylphenol calcium salt which is known as a metal-containing detergent.

The overbased sulfurized alkylphenol calcium salt is a calcium salt of a sulfurized alkylphenol having an alkyl group containing approx. 8 to 30 carbon atoms. An example of the overbased sulfurized alkylphenol calcium salt, detergent is an overbased sulfurized alkylphenol calcium salt having TBN (Total Base Number) in the range of 200 to 300 mg·KOH/g. The overbased sulfurized alkylphenol calcium salt can be used in combination with a law TBN calcium alkylphenate having TBN of lower than 200 mg·KOH/g (particularly, TBN 50 to 180 mg·KOH/g).

In the lubricating oil composition of the invention, two or three overbased alkylsalicylic acid calcium salts having different base numbers and hydrocarbyl groups. The overbased alkylsalicylic acid calcium salts used in the invention are metal-containing detergents which are obtained by neutralizing salicylic acids (or their derivatives) having a hydrocarbyl group containing the defined carbon atom number (which is defined in the invention by the range of the carbon atom number) with an excessive amount of a calcium base, and are already known.

The overbased alkylsalicylic acid calcium salts preferably contains an alkylsalicylic acid calcium salt having a high base number. The alkylsalicylic acid calcium salt having a high base number is particularly effective for reducing wear of the piston top ring.

Nitrogen-Containing Dispersant

The lubricating oil composition of the invention further contains a borated nitrogen-containing ashless dispersant (nitrogen-containing ashless dispersant having a boron atom in its molecular structure).

Examples of the nitrogen-containing ashless dispersants employed in the lubricating oil composition of the invention include succinimide, benzylamine, and other ashless dispersants obtained by modifying the succinimide or benzylamine with an organic acid, an inorganic acid, an alcohol, or an ester. Most preferred nitrogen-containing ashless dispersant is a succinimide dispersant. The succinimide dispersant is prepared, for instance, by reacting polybutene having an average molecular weight in the range of 800 to 8,000 or a chlorinated polybutene having an average molecular weight in the range of 800 to 8,000 with maleic anhydride at a temperature of 100 to 200° C.), and then with a polyamine. Examples of the polyamines include diethylenetriamine, triethylenetetramine, tetraethylenepentamine, pentaethylenehexamine, and hexaethyleneheptamine. The borated nitrogen-containing ashless dispersant employed in the invention can be obtained by reacting the above-mentioned polybutenyl-succinic acid-polyamine reaction compound with boric acid or a boric acid derivative.

Zinc Dihydrocarbyldithiophosphate

Examples of the zinc dihydrocarbyldithiophosphates include zinc dialkyldithiophosphate and zinc diaryldithiophosphate.

The zinc dialkyldithiophosphate preferably has a linear or branched alkyl group. The alkyl group can be a primary alkyl group, a secondary alkyl group, or a tertiary alkyl group, such as ethyl, propyl, isopropyl, butyl, isobutyl, pentyl, hexyl, heptyl, octyl, decyl, dodecyl, or octadecyl. Preferred is a zinc dialkyldithiophosphate having a primary alkyl group.

The zinc diaryldithiophosphate preferably is a zinc dialkylaryldithiophosphate containing a phenyl having a $C_2$ to $C_{18}$ alkyl group, such as butylphenyl, nonylphenyl, or dodecylphenyl.

Preparation of Lubricating Oil Composition

The lubricating oil composition of the invention can be prepared by separately or simultaneously adding the additive component to the base oil. Otherwise, an additive composition, containing each additive component at a high concentration is first prepared, and then the additive composition is mixed with the base oil.

Further, the lubricating oil composition of the invention can further contain various known lubricating oil additives.

EXAMPLES OF THE INVENTION

The invention is further described by the non-limiting examples given below.

Examples 1-2 and Comparison Examples 1-4

Preparation of Lubricating Oil Composition

Six lubricating oil compositions (TBN is 30 mg·KOH/g and SAE 40 for all oil compositions) were prepared by dissolving or dispersing the below-mentioned additive components in base oils in amounts set forth in Table 1.

The additive components and base oil employed are set forth below:

(1) Overbased sulfurized alkylphenol calcium salt (Phenate): phenate having TBN 250 mg·KOH/g (Ca content: 9.6 wt. %)

(2) Overbased alkylsalicylic acid calcium salt A (Salicylate A): salicylate having a base ratio of 2.0 and a hydrocarbyl group containing 14 to 18 carbon atoms (mixture, TBN: 170 mg·KOH/g, Ca content: 6.1 wt. %)

(3) Overbased alkylsalicylic acid calcium salt B (Salicylate B): salicylate having a base ratio of 4.8 and a hydrocarbyl group containing 20 to 28 carbon atoms (mixture, TBN: 275 mg·KOH/g, Ca content: 9.89 wt. %)

(4) Ashless dispersant: borated bis-type polybutenylsuccinimide (N content: 1.95 wt %, B content: 0.66 wt. %).

(5) Zinc dihydrocarbyldithiophosphate (Zn-DTP): zinc primary-alkyldithiophosphate (P content: 7.4 wt. %)

(6) Base oil: base oil (mixture) having a kinetic viscosity of 1.20 $mm^2/s$ (at 40° C.)

(Evaluation of Lubricating Oil Composition)

Bach lubricating oil composition was subjected to Falex friction test (which was known for evaluating wear of the piston top ring of trunk piston diesel engines) under the following test conditions.

Temperature of the Test Oil: 100° C.

Step-up loads: 5 min. under 115 kg, 5 min. under 227 kg, and finally 20 min. under 340 kg Evaluation procedure: amount of wear of the pin (mg) was measured. The less amount of wear is preferred.

The tested lubricating oil compositions, the additive compositions, and the results of evaluation are set forth in Table 1.

TABLE 1

| | | Examples | | Comparison Examples | | | |
|---|---|---|---|---|---|---|---|
| | | 1 | 2 | 1 | 2 | 3 | 4 |
| Phenate | Ca % | 0.125 | 0.22 | — | 0.125 | 0.22 | 0.55 |
| Salicylate A | Ca % | 0.43 | 0.39 | 0.24 | — | 0.85 | 0.53 |
| Salicylate B | Ca % | 0.63 | 0.57 | 0.83 | 0.95 | — | — |
| Dispersant | N % | 0.016 | 0.016 | 0.016 | 0.016 | 0.016 | 0.016 |
| | B % | 0.005 | 0.005 | 0.005 | 0.005 | 0.005 | 0.005 |
| Zn-DTP | P % | 0.04 | 0.04 | 0.04 | 0.04 | 0.04 | 0.04 |
| Pin wear | (mg) | 1.3 | 2.8 | 8.6 | 4.1 | 4.7 | 13.9 |

Examples 3-4 and Comparison Examples 5-8

Preparation of Lubricating Oil Composition

Six lubricating oil compositions (TBN is 30 and SAE 40 for all oil compositions) were prepared by dissolving or dispersing the below-mentioned additive components in base oils in amounts set forth in Table 2.

The additive components and base oil employed are set forth below:

(1) Overbased sulfurized alkylphenol calcium salt (Phenate): phenate having TEN 250 mg·KOH/g (Ca content: 9.6 wt. %)

(2) Overbased alkylsalicylic acid calcium salt A (Salicylate A): salicylate having a base ratio of 2.0 and a hydrocarbyl group containing 14 to 18 carbon atoms (mixture, TBN: 170 mg·KOH/g, Ca content: 6.1 wt. %)

(3) Overbased alkylsalicylic acid calcium salt C (Salicylate C): salicylate having a base ratio of 4.0 and a hydrocarbyl group containing 20 to 28 carbon atoms (mixture, TBN: 230 mg·KOH/g, Ca content: 8.2 wt. %)

(4) Overbased alkylsalicylic acid calcium salt C (Salicylate D): salicylate having a base ratio of 8.0 and a hydrocarbyl group containing 20 to 28 carbon atoms (mixture, TBN: 320 mg·KOH/g, Ca content: 11.4 wt. %)

(5) Ashless dispersant: borated bis-type polybutenylsuccinimide (N content: 1.95 wt. %, B content: 0.66 wt. %)

(6) Zinc dihydrocarbyldithiophosphate (Zn-DTP): zinc primary-alkyldithiophosphate (P content: 7.4 wt. %)

(7) Base oil: base oil (mixture) having a kinetic viscosity of 120 $mm^2/s$ (at 40° C.)

(Evaluation of Lubricating Oil Composition)

Each lubricating oil composition was subjected to Falex friction test (which was known for evaluating wear of the piston top ring of trunk piston diesel engines) under the following test conditions.

Temperature of the test oil: 100° C.

Step-up loads: 5 min. under 115 kg, 5 min. under 227 kg, and finally 20 min. under 340 kg Evaluation procedure: amount of wear of the pin (mg) was measured. The less amount of wear is preferred.

The tested, lubricating oil compositions, the additive compositions, and the results of evaluation are set forth in Table 2.

TABLE 2

| | | Examples | | Comparison Examples | | | |
|---|---|---|---|---|---|---|---|
| | | 3 | 4 | 5 | 6 | 7 | 8 |
| Phenate | Ca % | 0.09 | 0.22 | — | 0.09 | 0.22 | 0.55 |
| Salicylate A | Ca % | 0.39 | 0.18 | 0.24 | 0.39 | 0.85 | 0.53 |
| Salicylate C | Ca % | 0.25 | 0.30 | 0.37 | 0.60 | — | — |
| Salicylate D | Ca % | 0.35 | 0.37 | 0.46 | — | — | — |
| Dispersant | N % | 0.016 | 0.016 | 0.016 | 0.016 | 0.016 | 0.016 |
| | B % | 0.005 | 0.005 | 0.005 | 0.005 | 0.005 | 0.005 |
| Zn-DTP | P % | 0.04 | 0.04 | 0.04 | 0.04 | 0.04 | 0.04 |
| Pin wear | (mg) | 1.5 | 3.5 | 9.0 | 4.6 | 4.7 | 13.9 |

What is claimed is:

1. A lubricating oil composition comprising the below-described additive components dissolved or dispersed in a base oil;

1) an overbased sulfurized alkylphenol calcium salt having a TBN of 200 to 300 mgKOH/g, in an amount of 0.06 to 0.25 wt. % in terms of a calcium content;

(2) an overbased alkylsalicylic acid calcium salt having a base ratio of 1.8 to 2.5 and one hydrocarbyl group of 14 to 18 carbon atoms, the base ratio being expressed in terms of a calcium content in an overbase portion per a calcium content in a soap portion, in an amount, of 0.05 to 0.7 wt. % in terms of a calcium content;

(3) an overbased alkylsalicylic acid calcium salt having a base ratio of 4.2 to 5.8 and one hydrocarbyl group of 20 to 28 carbon atoms, the base ratio being expressed in terms of a calcium content in an overbase portion per a calcium content in a soap portion, in an amount of 0.19 to 1.05 wt. % in terms of a calcium content;

(4) a borated ashless dispersant in an amount of 0.005 to 0.06 wt. % in terms of a nitrogen content and 0.001 to 0.02 wt. % in terms of a boron content; and (5) a zinc dihydrocarbyldithiophosphate in an amount of 0.01 to 0.1 wt. % in terms of a phosphorus content.

2. The lubricating oil composition, of claim 1, which has a TBN of 20 to 60 mgKOH/g.

3. The lubricating, oil composition of claim 1, in which the overbased alkylsalicylic acid calcium salt of (2) has a TBN of 120 to 220 mgKOH/g.

4. The lubricating oil composition of claim 1, in which the overbased alkylsalicylic acid calcium salt of (3) has a TBN 230 to 340 mgKOH/g.

5. The lubricating oil composition of claim 1, in which the borated ashless dispersant is a succinimide compound containing a boron atom in a molecular structure thereof.

6. The lubricating oil composition of claim 1, in which the zinc dihydrocarbyldithiophosphate is a primary zinc dihydrocarbyldithiophosphate.

7. A lubricating oil composition comprising the below-described additive components dissolved or dispersed in a base oil:

(1) an overbased sulfurized alkylphenol calcium salt having a TBN of 200 to 300 mgKOH/g, in an amount of 0.06 to 0.40 wt. % in terms of a calcium content;

(2) an overbased alkylsalicylic acid calcium salt having a base ratio of 1.8 to 2.5 and one hydrocarbyl group of 14 to 18 carbon atoms, the base ratio being expressed in terms of a calcium content in an overbase portion per a calcium content in a soap portion, in an amount of 0.05 to 0.5 wt. % in terms of a calcium content;

(3) an overbased alkylsalicylic acid calcium salt having a base ratio of 3.6 to 4.5 and one hydrocarbyl group of 20 to 28 carbon atoms, the base ratio being expressed in terms of a calcium content in an overbase portion per a calcium content in a soap portion, in an amount of 0.08 to 1.55 wt. % in terms of a calcium content;

(4) an overbased alkylsalicylic acid calcium salt having a base ratio of 7.7 to 8.7 and one hydrocarbyl group of 20 to 28 carbon atoms, the base ratio being expressed in terms of a calcium content of an overbase portion per a calcium content of a soap portion, in an amount of 0.1 to 0.7 wt. % in terms of a calcium content;

(5) a borated ashless dispersant in an amount of 0.005 to 0.06 wt. % in terms of a nitrogen content and 0.001 to 0.02 wt. % in terms of a boron content; and (6) a zinc dihydrocarbyldithiophosphate in an amount of 0.01 to 0.1 wt. % in terms of a phosphorus content.

8. The lubricating oil composition of claim 7, which has a TBN of 20 to 60 mgKOH/g.

9. The lubricating oil composition of claim 7, in which the overbased alkylsalicylic acid calcium salt of (2) has a TBN of 120 to 220 mgKOH/g.

10. The lubricating oil composition of claim 7, in which the overbased alkylsalicylic acid calcium salt of (3) has a TBN 200 to 270 mgKOH/g.

11. The lubricating oil composition of claim 7, in which the overbased alkylsalicylic acid calcium salt of (4) has a TBN 280 to 350 mgKOH/g.

12. The lubricating oil composition of claim 7, in which the borated ashless dispersant is a succinimide compound containing a boron atom in a molecular structure thereof.

13. The lubricating oil composition of claim 7, in which the zinc dihydrocarbyldithiophosphate is a primary zinc dihydrocarbyldithiophosphate.

14. A method for reducing top ring piston wear of a four stroke trunk piston engine comprising operating said engine with the lubricating oil composition of claim 1.

15. A method for reducing top ring piston wear of a four stroke trunk piston engine comprising operating said engine with the lubricating oil composition of claim 7.

* * * * *